US007575232B2

(12) United States Patent
Willis

(10) Patent No.: US 7,575,232 B2
(45) Date of Patent: Aug. 18, 2009

(54) MEDIA PATH CROSSOVER CLEARANCE FOR PRINTING SYSTEM

(75) Inventor: Keith L. Willis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 518 days.

(21) Appl. No.: 11/291,860

(22) Filed: Nov. 30, 2005

(65) Prior Publication Data

US 2007/0120935 A1 May 31, 2007

(51) Int. Cl.
*B65H 5/00* (2006.01)

(52) U.S. Cl. ..... 271/225; 271/273; 399/124

(58) Field of Classification Search ..... 271/225, 271/264, 272, 273, 274, 3.19, 9.01, 9.13, 271/279, 287, 288, 298; 399/21, 110, 124, 399/388, 391

See application file for complete search history.

(56) References Cited

U.S. PATENT DOCUMENTS 4,579,446 A 4/1986 Fujino et al.
4,587,532 A 5/1986 Asano
4,615,446 A * 10/1986 Pavie ..... 209/583
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,457,524 A 10/1995 Metcalf et al.
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Patrick H Mackey
*Assistant Examiner*—Jeremy Severson
(74) *Attorney, Agent, or Firm*—Fay Sharpe LLP

(57) ABSTRACT

A media path crossover for a printing system includes a first crossover pathway on which sheets of print media are conveyed across a crossover junction without interruption and a second crossover pathway on which sheets of print media are conveyed across the crossover junction without interruption. The second crossover pathway intersects the first crossover pathway at a crossover junction. The first crossover pathway comprises a first input path and a first output path and the second crossover pathway comprises a second input path and a second output path. At least the first input path includes a first access panel, whereby a sheet can be cleared therefrom while continuing conveyance of media along the second crossover pathway.

12 Claims, 4 Drawing Sheets

U.S. PATENT DOCUMENTS

| | | | | |
|---|---|---|---|---|
| 5,884,910 | A | 3/1999 | Mandel | |
| 5,995,721 | A | 11/1999 | Rourke et al. | |
| 6,059,284 | A | 5/2000 | Wolf et al. | |
| 6,101,354 | A * | 8/2000 | Nakagawa et al. | 399/225 |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 * | 8/2004 | Biegelsen et al. | 271/303 |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2004/0251607 | A1 * | 12/2004 | Mandel et al. | 271/220 |
| 2005/0158094 | A1 * | 7/2005 | Mandel et al. | 399/391 |
| 2005/0271400 | A1 * | 12/2005 | Okamoto et al. | 399/21 |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

MEDIA PATH CROSSOVER CLEARANCE FOR PRINTING SYSTEM

BACKGROUND

The exemplary embodiment relates to the printing arts. It finds particular application in connection with the transport of print media through a paper path intersection within a printing system, and will be described with particular reference thereto. However, it will be appreciated that the exemplary embodiment finds application in other systems.

Electronic image forming systems, such as printing systems, typically employ an input terminal which receives images in digital form and conversion electronics for converting the image to image signals or pixels. For example, the printing system may include a scanner for scanning image-bearing documents or be connected to a computer network which supplies the digital images. The image signals are stored and are read out successively to a marking engine for formation of the images and transfer of the images to a print medium, such as sheets of paper.

In typical xerographic (electrophotographic) printing systems, such as copy machines and laser beam printers, the marking engine includes a photoconductive insulating member, which is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules, which is often referred to simply as toner. The developed image is subsequently transferred to the paper. The fusing of the toner image onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the paper to create a multi-layered toner image on the paper. The multi-layered toner image is then permanently affixed to the paper in the fusing process.

Printing systems have been developed which employ multiple marking engines for providing higher print outputs by distributing a print job among the marking engines. These systems may include several black, process (or full) color, and/or custom color (single color or monochrome) marking engines for printing of selected pages within a print job. A conveyor system transports the sheets of print media within the printing system. Decision gates can be used to control the flow of sheets through the points where one pathway merges with another, to prevent collisions between merging sheets. The gate is controlled to open when there is a sufficient inter-document gap for an incoming sheet to merge with the sheets already on a pathway.

The timing of the decision gate, its actuation, and return for a subsequent sheet are often critical for efficient operation of the printing system. However, the decision gate includes mechanical components, such as solenoids, linkages, springs, and a gate which can wear and fail to function over time resulting in lower reliability of the system. In addition, the gate tends to create a catch point area where the sheets may jam. Typical jam clearance usually results in a shutdown of the system. Further, the gate takes a finite amount of time to operate, which may limit the maximum productivity of the printing system, particularly when the gate is in frequent use. Another problem arises from merging the output of multiple marking engines. The relatively lower speed output of each marking engine is generally merged into an accelerated, high velocity main media pathway.

CROSS REFERENCE TO RELATED PATENTS AND APPLICATIONS

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

Application Ser. No. 11/235,979, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

Application Ser. No. 11/236,099, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. application Ser. No. 10,761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. C-I-P application Ser. No. 11/137,273, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/11/156,778, filed Jun. 20, 2005, entitled "PRINTING PLATFORM," by Joseph A. Swift;

U.S. application Ser. No. 11/_____ (Attorney Docket 20041435-US-NP), filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM", by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS", by Goodman, et al.;

U.S. application Ser. No. 11/234,553, filed Sep. 23, 2005, entitled "MAXIMUM GAMUT STRATEGY FOR THE PRINTING SYSTEMS", by Michael C. Mongeon;

U.S. application Ser. No. 11/234,468, filed Sep. 23, 2005, entitled "PRINTING SYSTEM", by Eric Hamby, et al.;

U.S. application Ser. No. 11/247,778, filed Oct. 11, 2005, entitled "PRINTING SYSTEM WITH BALANCED CONSUMABLE USAGE", by Charles Radulski, et al.;

U.S. application Ser. No. 11/248,044, filed Oct. 12, 2005, entitled "MEDIA PATH CROSSOVER FOR PRINTING SYSTEM", by Stan A. Spencer, et al.

INCORPORATION BY REFERENCE

U.S. Pat. No. 6,925,283, entitled "HIGH PRINT RATE MERGING AND FINISHING SYSTEM FOR PRINTING," by Mandel, et al., and Published Application 2005/0158094, entitled "HIGH PRINT RATE MERGING AND FINISHING SYSTEM FOR PARALLEL PRINTING," by Mandel, et al., the disclosures of which are incorporated herein in their entireties by reference, both disclose a media path system operable to transport the printed media from marking engines to one or more finishing stations such that the streams are merged and transported one on top of the other. A gate system controls a media path element where the paths merge.

U.S. Pat. No. 5,457,524, entitled "DUAL PATH SHEET FEEDER," by Metcalf, et al., the disclosure of which is incorporated herein in its entirety by reference, discloses a dual path sheet feeder, wherein a movable gate is situated adjacent to a sheet feeding tray for directing sheets along a predetermined path of travel. The movable gate is selectively positionable between a first position for directing the sheets to a processing module to produce copy sheets and a second position for directing the sheets directly to the finishing module to bypass the processing module to provide an insert sheet.

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages): U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al., U.S. application Ser. No. 10/924,459, filed Aug. 23, 2004, entitled "PARALLEL PRINTING ARCHITECTURE USING IMAGE MARKING ENGINE MODULES," by Mandel, et al., U.S. Pat. Nos. 5,568,246 to Keller, et al., 4,587,532 to Asano, 5,570,172 to Acquaviva, 5,596,416 to Barry, et al.; 5,995,721 to Rourke et al; 4,579,446 to Fujino; 5,489,969 to Soler, et al.; 6,606,165 and 6,888,644 to Barry, et al., a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

Aspects of the exemplary embodiment relate to a media path crossover, to a printing system incorporating a media path crossover, and to a method of printing whereby complete shutdown of the printing system is minimized.

In one aspect, a media path crossover includes a first crossover pathway on which sheets of print media are conveyed across a crossover junction without interruption and a second crossover pathway on which sheets of print media are conveyed across the crossover junction without interruption. The second crossover pathway intersects the first crossover pathway at a crossover junction. The first crossover pathway comprises a first input path and a first output path and the second crossover pathway comprises a second input path and a second output path. At least the first input path includes a first access panel, whereby a sheet can be cleared therefrom while continuing conveyance of media along the second crossover pathway.

In another aspect, a printing system includes a first print media processing unit and a second print media processing unit. A media path crossover includes a first crossover pathway on which sheets of print media are conveyed and a second crossover pathway on which sheets of print media are conveyed. The first crossover pathway receiving print media which has bypassed the first print media processing unit. The second crossover pathway receiving print media from the first print media processing unit, the second crossover pathway intersecting the first crossover pathway at a crossover junction. One of the first and second crossover pathways being connected with the second print media processing unit. A first access panel for clearing a sheet from one of the first and second crossover pathways while conveying print media along another of the first and second crossover pathways.

In another aspect, a method of printing includes conveying sheets of print media on a first crossover pathway of a print media crossover and conveying sheets of print media on a second crossover pathway of the print media crossover which intersects the first crossover pathway at a junction. The method further includes clearing at least one sheet from one of the first crossover pathway and the second crossover pathway while another sheet is conveyed on the other of the first crossover pathway and the second crossover pathway.

DETAILED DESCRIPTION

Figure 1:
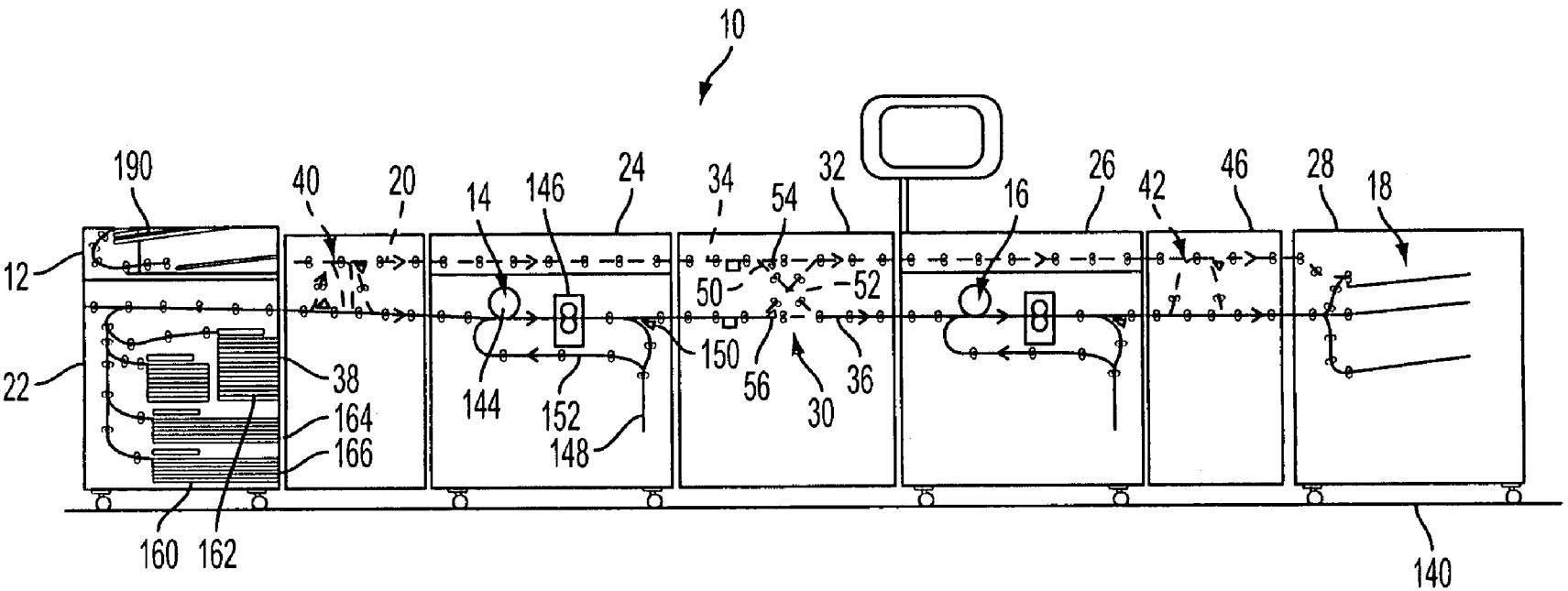
FIG. 1 is a schematic view of a printing system incorporating a media path crossover according to aspects of the exemplary embodiment.

Aspects of the exemplary embodiment relate to a media path crossover for a printing system, to a printing system which incorporates the media path crossover, and to a method, strategy, and system for clearing various media jam scenarios or locations. The media path crossover includes first and second pathways which intersect at a crossover junction. The first pathway includes an input path which carries sheets of print media to the crossover junction and an output path which carries the print media sheets from the junction, the output path receiving print media sheets from the input path. Similarly, the second pathway includes an input path which carries print media sheets to the crossover junction and an output path which carries print media sheets from the junction, the output path receiving print media sheets from the input path. The crossover junction serves as a portion of both pathways. Sheets traveling on the first and second pathways can both pass through the junction. However, a sheet cannot traverse the junction from one of the pathways while a sheet in the other pathway is simultaneously in the junction as this would result in a collision. Accordingly, the entry of sheets to the crossover junction can be staggered. Specifically, a control system can control the arrival of print media sheets at the crossover junction whereby sheets on the first pathway traverse the junction in intersheet gaps between sheets traversing the junction on the second pathway. In this way, collisions between sheets can be avoided without the need for a gate system. The crossover can thus be non-gated, i.e., sheets entering the junction from one or both pathways need not be interrupted by a gate, but are timed to arrive at the junction in the intersheet gaps. The crossover and its components (such as baffles) are thus passive, in that they remain in the same position irrespective of the direction of movement of the print media through the crossover. It will be appreciated that a gate may be provided within the crossover for use in some applications but that the crossover can still be run in a not-gated mode where the gate is not closed between sheets of a print job or otherwise operated to interrupt the flow.

In various aspects, the printing system includes a plurality of marking engines and a conveyor system which conveys print media between the marking engines and a common output destination. The conveyor system includes a media path crossover whereby sheets which have been marked by a first of the marking engines can bypass a second of the marking engines and/or sheets which have bypassed the first marking engine can be marked by the second marking engine.

The media path crossover is particularly suited to printing systems comprising marking engines which can selectively operate in two modes: a first mode, such as a simplex mode and a second mode, such as a tandem duplex mode. In the first mode, a portion of the sheets can be marked by a first marking engine and bypass a second marking engine and a different portion of the sheets can be marked in the second marking engine, bypassing the first marking engine. The outputs of the two marking engines can then be merged into a single stream and the marked sheets subsequently assembled at the common output destination. This can be used for simplex printing, in which the two marking engines only print on one side of the sheets. Alternatively, in some embodiments, the first mode may be used for single engine duplex printing, where there are print media pathways provided for returning print media to the same marking engine. In single engine duplex printing, sheets printed by a marking engine are inverted and routed to the same marking engine for printing on the other side of the sheet. As with simplex printing, in single engine duplex printing, a portion of the sheets can be printed on the first marking engine and a second, different portion of the sheets can be printed on the second marking engine.

In the second mode, a sheet can be marked by the first marking engine, inverted, and conveyed to the second marking engine for printing on the other side of the same sheet (tandem duplex printing). Alternatively, in the second mode, in some embodiments, sheets can be conveyed from the first marking engine to the second marking engine without inversion, for marking on the same side of the sheet (overprinting).

When operated in the first mode, all or a large proportion of the sheets pass through the media path crossover. In the second mode, sheets can be directed directly from the first marking engine to the second marking engine, bypassing the media path crossover. Such a printing system has advantages over one which employs a gated sheet merging system in that relatively high speeds can be maintained for the sheets passing through the junction and it avoids the aforementioned problems which may arise when a gate is used. It will be appreciated, however, that the media path crossover is not limited to such uses and may be used in other applications where print media pathways intersect. For example, the media path crossover may be used to selectively direct sheets output from two or more marking engines to two or more output destinations or to selectively direct print media from two or more print media sources to two or more marking engines.

In another 'degraded' mode (i.e. when one of the marking engines is not functioning), a sheet can bypass the first marking engine and be conveyed to the second marking engine for printing on one or both sides of the sheet. Alternatively, in the degraded mode, sheets can be printed on one or both sides of the sheet by the first marking engine and then conveyed through the media path crossover and around the second marking engine.

The term "marking engine" is used herein generally to refer to a device for applying an image to print media. Print media generally refers to a usually flexible, sometimes curled, physical sheet of paper, plastic, or other suitable physical print media substrate for images, whether precut or web fed. A "printing system" can be a digital copier or printer, bookmaking machine, facsimile machine, multi-function machine, or the like and can include several marking engines, as well as other print media processing units, such as paper feeders, finishers, and the like. "Print jobs" or "documents" generally include a plurality of digital "pages" to be rendered as one or more copies on a set of associated sheets of print media, each page, when rendered, constituting the front or back side of a sheet. The pages of a print job may arrive from a common source and, when rendered, be assembled at a common output destination.

The printing system generally can include two or more marking engines of the same print modality, such as black only (K), process color (P), or custom color (C) marking engines, and which can be used interchangeably for at least some of the print jobs or portions thereof that are handled by the printing system. The printing system may be configured for parallel printing such that portions of a print job may be distributed among two or more marking engines of the same print modality and then assembled as a single document or such that several print jobs may be distributed among the marking engines whereby two or more print jobs may be printed contemporaneously. Additionally or alternatively, the printing system may be configured for printing opposite sides of a sheet on different marking engines (tandem duplex printing).

With reference to FIG. 1, an exemplary printing system 10 in which the media path crossover and printing methods disclosed herein may be employed is shown. The printing system 10 may be a printer, copier, or a multifunction device having both printing and copying capabilities. The illustrated printing system 10 is a modular system and includes a plurality of print media processing units, such as a print media source 12, a plurality of marking engines 14, 16, and an output destination 18, such as a finisher. The processing units 12, 14, 16, and 18 are all interconnected by a print media conveyor system 20.

In some embodiments, one or more of the print media processing units are modular and are housed in a respective housing 22, 24, 26, and 28. The modules may be interconnectable and interchangeable to allow the printing system to be reconfigured so to include for fewer or more print media processing units. In some embodiments, one or more of the processing units 12, 14, 16, 18 are removable processing units. For example, the functional portion of a processing unit may be removed, leaving only the external housing 22, 24, 26, 28 or mounting fixture through which the print media conveyor 20 passes. In this manner, for example, the functional portion can be removed for repair, or can be replaced to effectuate an upgrade or modification of the printing system 10. While repairing or replacing is occurring, the system can continue to operate in the 'degraded' mode whereby media can be conveyed and marked by at least one other marking engine.

The printing system 10 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper source 12, marking engines 14, 16, and finisher 18 of the printing system 10. These capabilities may increase over time due to addition of new processing units or upgrading of existing processing units. The capabilities may also decrease over time due to failure or removal of one or more processing units.

The conveyor system 20 can include a media path crossover 30, which may be in the form of a separate module which is housed in its own housing 32, as shown, or may be incorporated into one or more of the other processing modules. In the illustrated embodiment, the media path crossover 30 connects parallel downstream main pathways 34, 36 of the conveyor system 20. Pathway 34 is a bypass pathway which conveys sheets 38 of print media between the print media source 12 and the output destination 18. The pathway 34 bypasses both marking engines 14, 16. Pathway 36 conveys sheets of print media from the first marking engine 14 to the second marking engine 16, e.g., for tandem duplex printing (where marking engines 14 and 16 print on opposite sides of the same sheet) or for overprinting (both marking engines 14 and 16 print on the same side of the sheet). Pathway 36 may also interconnect the first marking engine 14 with the paper source 12, and the second marking engine 16 with the output destination 18.

Sheets 38 of print media are conveyed between the pathways 34, 36 for selective direction of the sheets to one and/or the other of the marking engines 14, 16. In the illustrated embodiment, sheets are transferred between the main pathways 34, 36 via the media path crossover 30, at a location which is intermediate the first and second marking engines 14, 16. Sheets can also be transferred between the pathways 34, 36 in first and second bell modules 40, 42 located upstream of the first marking engine 14 and downstream of the second marking engine 16, respectively. The bell modules 40, 42 may be housed in respective housings 44, 46, and be replaceable and/or interchangeable conveyor modules of the printing system 10, as for the crossover module 30. In the illustrated embodiment, the bell modules 40, 42 space the marking engines 14, 16 from the print media source 12 and output destination 18, respectively. It is to be appreciated that the printing system may include additional conveyor modules to those illustrated.

Figure 2:
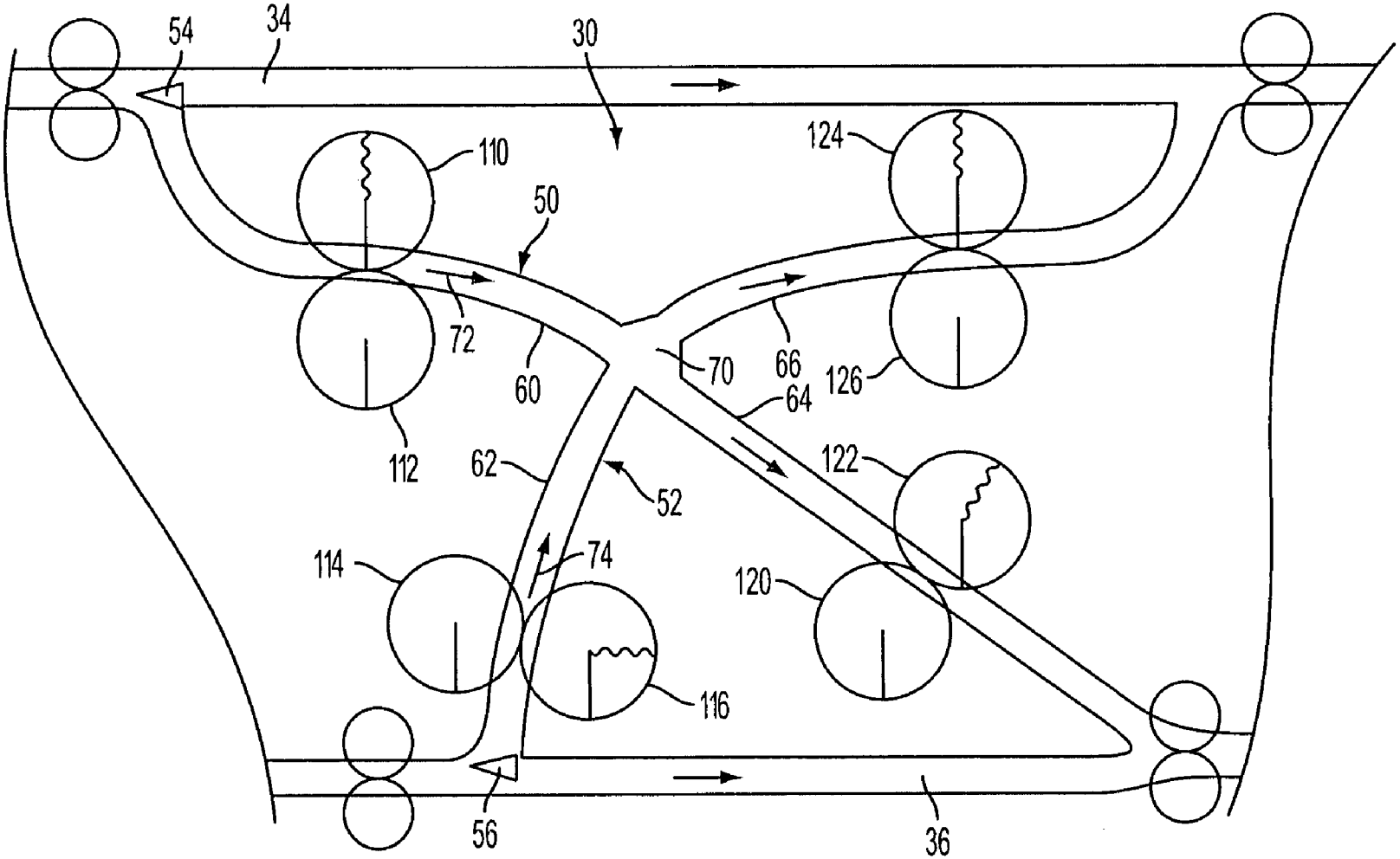
FIG. 2 is an enlarged cross sectional view of the media path crossover of FIG. 1.

With reference also to FIG. 2, the media path crossover 30 includes two intersecting pathways: a first crossover pathway 50 and a second crossover pathway 52. Ends of the pathways 50, 52 connect main pathways 34 and 36. In the embodiment of FIG. 1, pathway 50 conveys sheets of print media between pathways 34 and 36 such that print media which has bypassed marking engine 14 can be directed to marking engine 16 for marking. Similarly, pathway 52 conveys print media between pathways 36 and 34 such that print media which has been marked by marking engine 14 can bypass marking engine 16. In this way, the printing system 10 can be used for simplex printing or single engine duplex printing, in which the outputs of the two marking engines 14, 16 are combined to enable an increase in productivity of the system 10 over that of a single marking engine. When operated in a simplex printing mode, for example, a portion (typically half) of the sheets of a print job to be printed are transported via pathway 36 to marking engine 14 and are thereafter transferred from pathway 36 to pathway 34 at the media path crossover 30, thereby bypassing the second marking engine 16. A second portion (typically the remainder of the print job) is directed to marking engine 16. Sheets to be marked bypass marking engine 14 and then crossover from pathway 34 to pathway 36 via crossover 30. The two portions are subsequently combined in output order, for example, by merging the output of marking engine 14 into pathway 36 in the bell module 42, downstream of marking engine 16.

It is to be appreciated, that the media path crossover 30 may include more than two intersecting pathways. It is also contemplated that the printing system 10 may include more than one media path crossover 30. For example, a printing system which incorporates more than two marking engines may have additional media path crossovers. Additionally or alternatively, media path crossovers may be provided upstream of both marking engines 14, 16 and/or downstream of both marking engines, such as in the locations of the bell modules 40, 42.

With continued reference to FIGS. 1 and 2, the print media sheets may be directed from respective pathways 34, 36 into pathways 50, 52 by selectable decision gates 54, 56. The decision gates 54, 56 each have a first position, in which the print media continues on the main pathway 34, 36, respectively, and a second position, in which the print media is directed into the media path crossover 30. Decision gates of this type are disclosed, for example, in U.S. Pat. No. 5,457,524, incorporated herein in its entirety, by reference.

Figure 3:
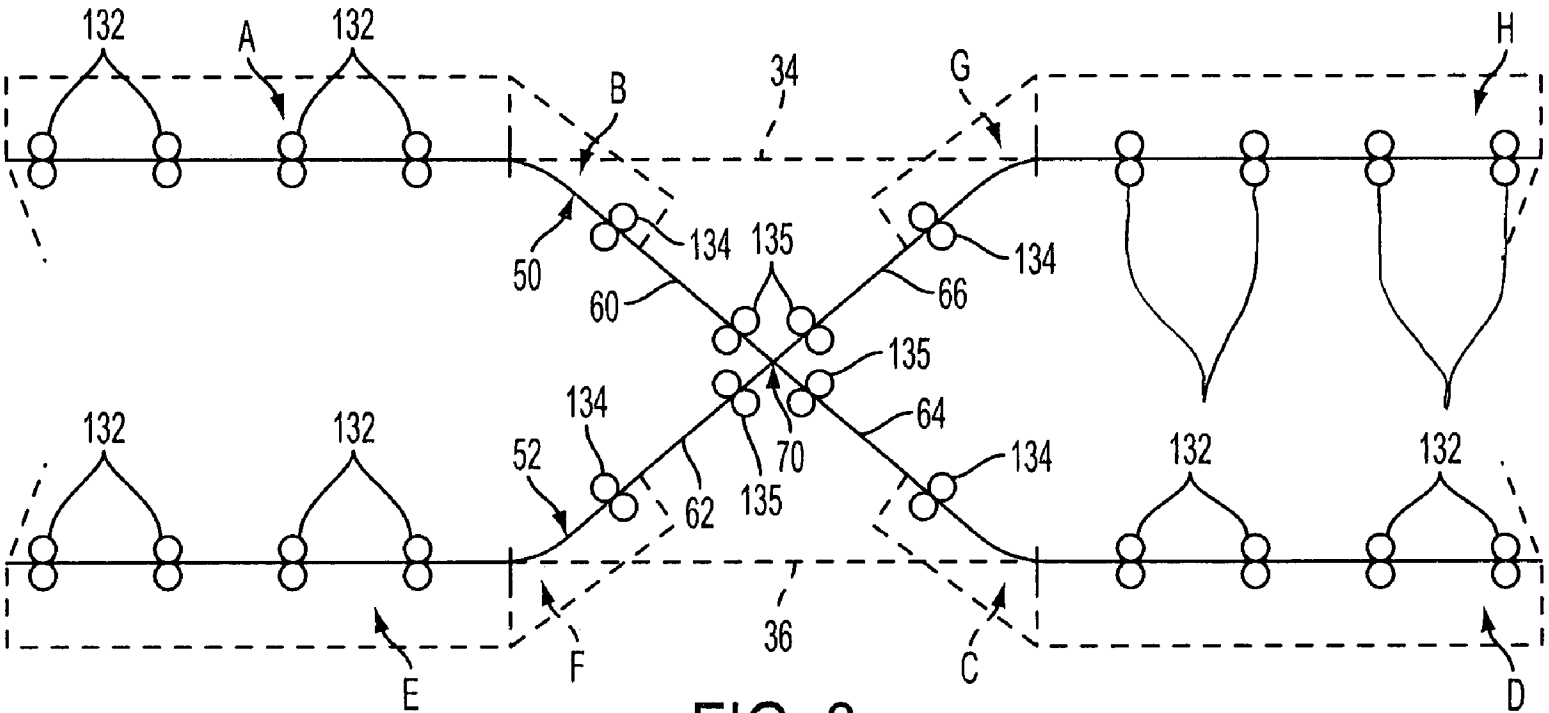
FIG. 3 is an enlarged cross sectional view of the media path crossover of FIG. 1 illustrating different jam locations or scenarios; and, FIG. 4 is an enlarged cross sectional view of the media path crossover illustrating further jam locations or scenarios.

With reference to FIG. 2 and reference also to FIG. 3, the pathways 50, 52 of the illustrated media path crossover 30 each include an inlet or input path 60, 62, and an outlet or output path 64, 66, respectively. The pathways 50, 52 cross at a four way junction 70, which connects input path 60 with output path 64, and input path 62 with output path 66. The illustrated junction 70 is configured such that sheets entering from inlet path 60 are steered toward outlet path 64 and sheets entering from inlet path 62 are steered toward outlet path 66. In general, sheets from path 60 are directed away from outlet path 66 and away from inlet path 62, such that the sheets continue along pathway 50. Similarly, sheets from path 62 are directed away from outlet path 64 and away from inlet path 60, such that the sheets continue along pathway 52.

In the simplex mode, the decision gates 54, 56 can be set in the position to direct all the print media to the crossover 30 for an entire print job or jobs to be simplex printed. In this way, successive sheets traverse the junction from either direction without interruption by a gate. Similarly, in the tandem duplex mode, the gate 56 is set such that all the print media of a print job is directed along main pathway 36, without interruption by a gate.

With reference to FIG. 2, the inlet paths 60, 62 of paths 50, 52 can be defined by a static baffle structure comprising baffles (not illustrated), which constrain the sheets 38 to travel along a general route indicated by arrows 72 and 74 and enter the junction 70. Similarly, the outlet paths 64, 66 can be defined by baffles (not illustrated). The positions of the baffles can be fixed.

The print media conveyor system 20 includes drive elements associated with each of the paper pathways 34, 36, 50, 52, etc., such as rollers, spherical balls, or air jets, which convey the print media along the pathways. The pathways may include diverters, inverters, interposers, and the like, as known in the art. As illustrated in FIG. 2, the media path crossover drive elements include pairs of inlet rollers 110, 112, 114, and 116 associated with inlet paths 60, 62. At least one roller 112,114 of each inlet pair is driven so as to rotate, in order to drive the print media sheets in the direction of the junction 70. The drive elements of crossover 30 also include pairs of outlet rollers 120, 122, 124, and 126 associated with outlet paths 64, 66. At least one roller 126, 120 of each outlet pair is driven so as to rotate, to drive the print media sheets in a direction away from the junction.

Figure 4:
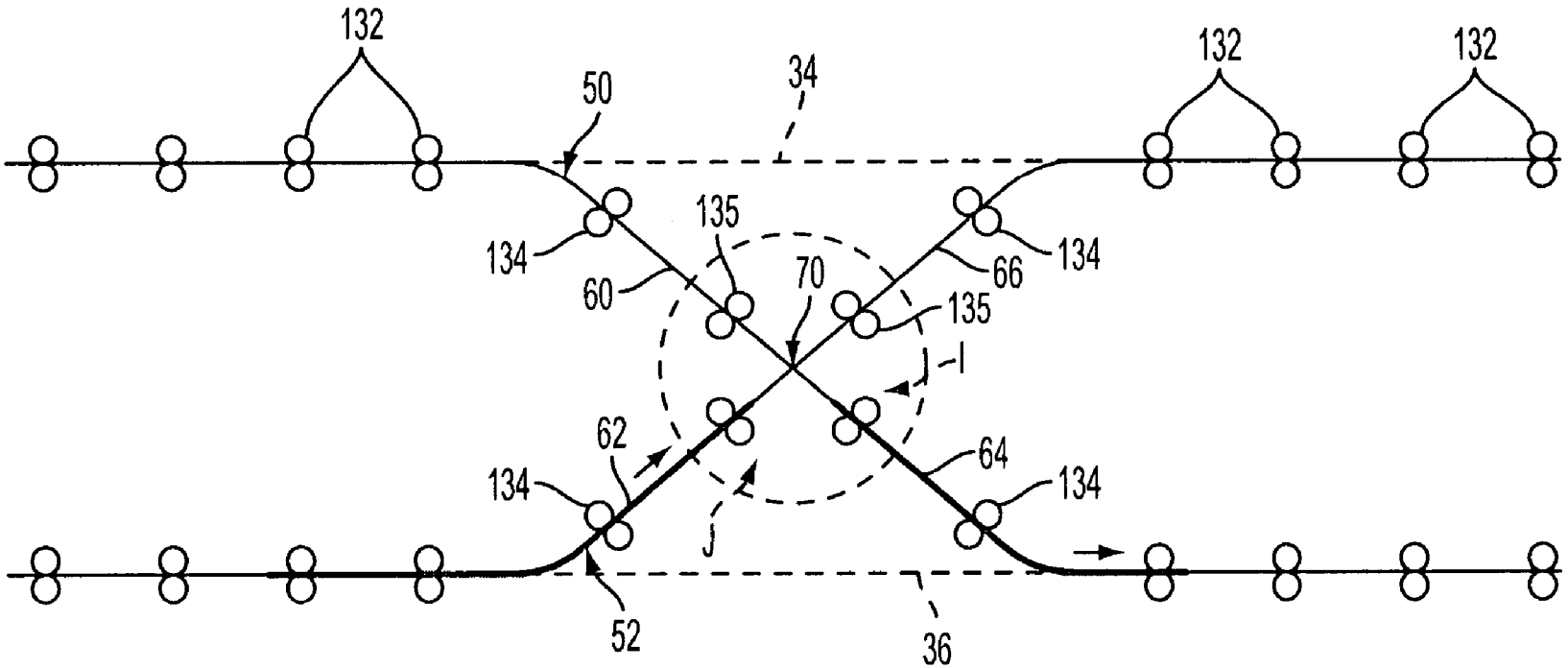

With reference to FIGS. 3-4, the jam clearing locations or scenarios are therein illustrated. It is to be appreciated that the inlet paths 60, 62 and the outlet paths 64, 66 can each include a drive system, for example, a series of nip transports 132 and a nip break 134. The nip transports 132 can selectively open for removal of media sheets. Similarly, nip breaks 134 can disengage for removal of media sheets. As shown in FIG. 3, jam areas or locations A, B, C, and D allow media sheets to be removed or cleared therefrom, along pathway 50, while other media sheets continue to be conveyed through pathway 52. Similarly, jam areas or locations E, F, G, and H allow media sheets to be removed or cleared therefrom, along pathway 52, while other media sheets continue to be conveyed through pathway 50. Areas B and F can each include a baffle entry, and areas C and G can each include a baffle exit. It is to be appreciated that each jam location A, B, C, D, E, F, G, H can include at least one access panel or door (not illustrated) to facilitate removal or clearance of media sheets.

Different media routing can be described, by way of example only, in order to convey media around jam areas. In particular, a jam in areas A and B still allows media to enter and exit print engine 14, traverse simplex path 36 and either enter or bypass print engine 16. A jam in areas C and D allows media to enter and exit print engine 14, traverse pathways 62 and 66 and bypass print engine 16. A jam in areas E and F allows media to bypass print engine 14, traverse pathways 60 and 64 to simplex pathway 36 for entry into print engine 16. A jam in areas G and H allows media to selectively enter or bypass print engine 14, traverse simplex path 36, and enter print engine 16. A jam in areas I and J at the center of the cross baffle or junction 70, i.e. in cross nips 135, does not allow media to continue to move through either pathway 50, 52 and will cause the system to shut down until the jam is cleared. As described above, the majority of jam scenarios enables one of the pathways 50 or 52 to remain functional in order to minimize complete system shutdown.

In some embodiments, return upstream pathways may be provided which enable print media to be directed from a downstream (i.e. 16) to an upstream marking engine (i.e. 14), as disclosed, for example, in copending U.S. application Ser. No. 11/137,251, filed May 25, 2005, entitled "SCHEDULING SYSTEM," by Robert M. Lofthus et al. Additionally, while the illustrated marking engines 14, 16 are shown in a horizontal arrangement, vertical arrangements, in which two or more marking engines are stacked in a tower, are also contemplated, as disclosed for example, in copending U.S. application Ser. No. 11/137,251 and in application Ser. No. 10/917,768 filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al., which is incorporated herein by reference in its entirety. While the illustrated marking engines are aligned in a linear arrangement, it is also contemplated that they may be stacked in a two or three dimensional configuration.

While pathway 34 is illustrated as an upper pathway and pathway 36 as a lower pathway which runs parallel to the upper pathway and generally horizontally, i.e., generally parallel with a support surface 140, such as the ground, on which the printing system is supported, it is to be appreciated that the positions of the pathways 34, 36 may be reversed, with pathway 36 being the upper pathway. In other embodiments, pathways 34, 36 may be arranged in other orientations, such as a horizontal, side by side by side arrangement, or in a generally vertical orientation. Additionally, while pathway 34 is shown as a bypass pathway which bypasses both marking engines 14,16, it is to be appreciated that the pathway 34 may alternatively be connected with the second marking engine and that the second pathway 36 may bypass the marking engine 16. In such an embodiment, the printing system 10 utilizes the crossover 30 when operating in the second mode, such as a tandem duplex mode, rather than in the first mode, such as a simplex mode.

It will be understood that while two marking engines 14,16 are illustrated, the number of marking engines can be any number, such as two, three, four, five, six, or more. The two illustrated marking engines 14, 16 may both be multi-color (process color, P) marking engines, such as CMYK marking engines. However, one or more of the marking engines 14, 16 may be a monochrome engine, such as a black (K) marking engine or a custom color (C) marking engine.

The illustrated marking engines 14, 16 employ xerographic printing technology, in which an electrostatic image is formed and coated with a toner material, and then transferred and fused to paper or another print medium by application of heat and/or pressure. However, marking engines employing other printing technologies can be provided as processing units, such as marking engines employing ink jet transfer, thermal impact printing, or the like. In a xerographic system, an image applying component 144, illustrated schematically by a photoreceptor, applies an image to the print media, and a fuser 146, such as a pair of rollers, one of which being heated, fixes the applied image to the print media by application of at least one of heat and pressure. Marking engines 14 and 16 may be similarly configured. The marking engine typically includes a charge retentive surface, such as a rotating photoreceptor in the form of a belt or drum. The images are created on a surface of the photoreceptor. Disposed at various points around the circumference of the photoreceptor are the xerographic subsystems, for forming an image and transferring the image to a sheet of paper which include a charging station for one or more of the colors to be applied, such as a charging corotron, an exposure station, which forms a latent image on the photoreceptor, such as a Raster Output Scanner (ROS) or LED bar, a developer unit, associated with each charging station for developing the latent image formed on the surface of the photoreceptor by applying a toner to obtain a toner image, a transfer unit, such as a transfer corotron, transfers the toner image thus formed to the surface of a print media substrate, such as a sheet of paper, or to an intermediate transfer belt. In one embodiment, each of four toners cyan, magenta, yellow, and black (CMYK) is applied to the same photoreceptor. In another embodiment, each may be applied to a separate photoreceptor, and the resulting image transferred to an intermediate transfer belt. The sheet with the applied image is conveyed to the fuser 146 for fixing. In any particular embodiment of an electrophotographic marking engine, there may be variations on this general outline, such as additional corotrons, cleaning devices, and the like.

With reference to FIG. 1, an inverter 148 can be connected with pathway 36, intermediate fuser 146 and marking engine 16. A decision gate 150 selectively directs marked media to the inverter 148 for inversion of the sheet. The inverter 148 may be bypassed when the printing system 10 operates in the first mode, such as a simplex mode. The illustrated marking engines 14, 16, both include a return pathway 152, by which print media which has been marked with image applying component 144 and fused with the fuser 146 is returned to the marking engine after inversion in the inverter 148, e.g., for single engine duplex printing.

The illustrated print media source 12 is a high capacity feeder which includes print media sources 160, 162, 164, 166, such as trays, which are connected with the print media conveyor system 20 to provide selected types of print media to all of the marking engines. While four print media sources are illustrated, the number of print media sources can be one, two, three, four, five, or more. In other embodiments, one or more of the marking engines in the printing system 10 may include its own dedicated print media source. Each of the print media sources 160, 162, 164, 166 can store sheets of the same type of print medium, or can store different types of print media. The print media can be substantially any type of medium upon which one or more of the marking engines 14, 16 can print, such as: high quality bond paper, lower quality "copy" paper, overhead transparency sheets, high gloss paper, heavy weight paper and card, paper of different sizes, and the like.

The print media conveyor system 20 is controllable to acquire sheets of a selected print medium from the print media sources 160, 162, 164, 166, transfer each acquired sheet to one or more of the installed marking engines 14, 16, to perform selected marking tasks, and then transfer each sheet to the finisher 18 to perform finishing tasks.

The printing system 10 is an illustrative example. In general, any number of print media sources, media handlers, marking engines, collators, finishers or other processing units can be connected together by a suitable print media conveyor configuration.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of printing comprising:

conveying sheets of print media in a staggered arrangement on a first crossover pathway of a print media crossover;

conveying sheets of print media in a staggered arrangement on a second crossover pathway of the print media crossover which intersects the first crossover pathway at a junction;

wherein the sheets on the first crossover pathway traverse the junction in intersheet gaps between the sheets traversing the junction on the second crossover pathway; and, clearing at least one sheet, through at least a first access panel, from one of the first crossover pathway and the second crossover pathway while another sheet is conveyed on the other of the first crossover pathway and the second crossover pathway.

2. The method of claim 1, wherein conveying sheets of print media on the first crossover pathway bypasses a first marking engine.

3. The method of claim 2, wherein conveying sheets of print media of the second crossover pathway bypasses a second marking engine.

4. The method of claim 1, wherein clearing the at least one sheet is from a first area between a first marking engine and the junction.

5. The method of claim 4, wherein the first area includes a first nip transport and a first nip break along the first crossover pathway.

6. The method of claim 5, wherein the first area further includes a first nip transport and a first nip break along the second crossover pathway.

7. The method of claim 1, wherein clearing the at least one sheet is from a second area, through at least a second access panel, between the junction and a second marking engine.

8. The method of claim 7, wherein the second area includes a second nip transport and a second nip break along the first crossover pathway.

9. The method of claim 8, wherein the second area further includes a second nip transport and a second nip break along the second crossover pathway.

10. The method of claim 1, wherein clearing the at least one sheet is from an area along the first and second crossover pathways selected from the group consisting of a first nip transport, a first nip break, a second nip transport, and a second nip break.

11. The method of claim 10, wherein the first and second nip transports selectively open.

12. The method of claim 10, wherein the first and second nip breaks selectively disengage.

* * * * *